United States Patent [19]

Purcaru

[11] Patent Number: 4,795,312

[45] Date of Patent: Jan. 3, 1989

[54] TURBO-MACHINE BLADE

[76] Inventor: Bebe-Titu Purcaru, Aktienstr. 200 - 204, 4330 Mülheim/Ruhr, Fed. Rep. of Germany

[21] Appl. No.: 456,547

[22] Filed: Jan. 10, 1983

[30] Foreign Application Priority Data

Jan. 19, 1982 [DE] Fed. Rep. of Germany ..... 3201436

[51] Int. Cl.[4] ..... B63H 1/26

[52] U.S. Cl. ..... 416/223 A; 416/243; 416/223 R

[58] Field of Search ..... 416/223 A, 223 R, 243

[56] References Cited

U.S. PATENT DOCUMENTS

| | | | |
|---|---|---|---|
| 2,258,795 | 10/1941 | New | 416/223 A |
| 3,077,173 | 2/1963 | Lang . | |
| 3,140,042 | 7/1964 | Fujii . | |
| 3,946,688 | 3/1976 | Gornstein et al. | 416/223 R |
| 4,431,376 | 2/1984 | Luaenstein et al. | 416/223 A |

FOREIGN PATENT DOCUMENTS

| | | | |
|---|---|---|---|
| 55-123301 | 9/1980 | Japan . | |
| 14802 | 2/1981 | Japan | 416/223 A |
| 252702 | 8/1927 | United Kingdom | 416/223 A |

*Primary Examiner*—Larry Jones

*Attorney, Agent, or Firm*—Lerner & Greenberg

[57] ABSTRACT

Turbo-machine blade, including: a continuously curved profile contour having convex curved leading edge, suction side and trailing edge regions, and a concave curved pressure side region; the leading edge section being formed of a first ellipse section and a second ellipse section adjacent the first ellipse section;

the suction side region being formed of a first circle section adjacent the second ellipse section and a first parabola section of a first second-order parabola being adjacent the first circle section; the trailing edge region being formed of a second circle section adjacent the first parabola section; and the pressure side region being formed of a third circle section adjacent the first ellipse section and a second parabola section of a second second-order parabola being disposed between the second circle section and the third circle section.

7 Claims, 1 Drawing Sheet

TURBO-MACHINE BLADE

Specification

The invention relates to a turbo-machine blade with a profile contour which is curved convex in the region of the leading edge, the suction side and the trailing edge and concave in the region of the pressure side, wherein the entire profile contour is a continuous curve and:

is formed in the region of the leading edge by a first ellipse section and a following second ellipse section;

is formed in the region of the suction side by a first circle section following the second ellipse section, and by a first parabola section of a second-order parabola following the first circle section;

is formed in the region of the trailing edge by a second circle section following the first parabola section; and is formed in the region of the pressure side by a third circle section following the first ellipse section.

Such a turbo-machine blade has already been proposed in U.S. application Ser. No. 286,894, filed July 27, 1981. The profile contour of this turbo-machine blade is composed sectionwise, of mathematically exactly defined second-order curves in such a way that the entire profile contour is a continuous curve. Thus, the profile area, the location of the center of gravity, the inclination of the principal axes of inertia, the moments of inertia, the bending resistance moments, the location of the thrust center, the rotation resistance and the torsional resistance moment can also be exactly calculated mathematically, and the exact knowledge of these quantities allows a reliable and exact calculation of the strength behavior and the vibration behavior. By suitable choice of the parameters of the second-order curves forming the profile contour, a profile contour can then be figured which meets the hydrodynamic or aerodynamic and mechanical requirements. In particular, after the hydrodynamic or aerodynamic calculations have been made, in which pressure distribution, exit angle, profile losses and the like are determined, an aerodynamic or hydrodynamic optimization can be achieved by making slight changes in the parameters without degrading the required strength properties. Further advantages of the above-described turbo-machine blade are obtained in production. The ordinary machining methods can be used, and due to the mathematically definable profile contour, the manufacturing accuracy can be increased considerably, since every point of the profile contour can be determined exactly and practically an unlimited number of reference points can be chosen.

In the turbo-machine blade described above, the profile contour is formed in the entire range of the pressure side by a section of a circle, wherein a relatively heavy increase of the component of the local acceleration of the flow normal to the profile contour, can occur along the pressure side with this kind of a constant curvature in the blade grid through which the medium flows. An excessive increase of the normal component of the local acceleration, however, leads to a thickening of the boundary layer forming on the pressure side, and thereby to larger aerodynamic losses.

It is accordingly an object of the invention to provide a turbomachine blade which overcomes the hereinafore-mentioned disadvantages of the heretofore-known devices of this general type, and to do so in such a manner that a smaller increase of the normal component of the local acceleration of the flow along the pressure side is obtained in the blade grid through which the medium flows.

With the foregoing and other objects in view there is provided, in accordance with the invention, a turbo-machine blade, comprising:

an entirely continuously curved profile contour having convex curved leading edge; suction side and trailing edge regions, and a concave curved pressure side region;

the leading edge region being formed of a first ellipse section and a second ellipse section adjacent or following the first ellipse section;

the suction side region being formed of a first circle section adjacent the second ellipse section and a first parabola section of a first second-order parabola being adjacent the first circle section;

the trailing edge region being formed of a second circle section adjacent the first parabola section; and the pressure side region being formed of a third circle section adjacent the first ellipse section and a second parabola section of a second-order parabola being disposed between the second circle section and the third circle section.

In the turbo-machine blade according to the invention, the profile contour is therefore formed in the region of the pressure side, not only by the second section of a circle, but by the second section of a circle and a second parabola section adjacent thereto toward the rear edge of a second-order parabola. This construction achieves the result that the curvature of a profile contour, which is constant in the region of the second circle section, decreases more and more in the region of the second parabola section toward the rear edge. Simultaneously with an increase of the flow velocity in the blade grid through which the medium flows, the curvature of the profile contour in the region of the pressure side therefore decreases, so that a smaller increase of the normal component of the local acceleration of the flow is obtained. With the smaller increase of the normal component of the local acceleration of the flow, however, a smaller thickness of the boundary layer forming on the pressure side is also then obtained, and lower aerodynamic losses occur. It is also important for reducing the aerodynamic losses, to make certain that in the region of the pressure side, the curvature of the profile contour does not decrease discontinuously, but continuously toward the rear edge corresponding to the curve of the second-order parabola.

In accordance with another feature of the invention, the first and the second ellipse sections are formed of respective first and second ellipses having a common major half-axis, and the first and second ellipse sections merge into each other at a common apex lying on the major half-axis.

In accordance with a further feature of the invention, the first and second ellipses have minor half-axes of equal length, i.e. the first and the second ellipse section appear as a section of a single ellipse.

If, in accordance with an added feature of the invention, all of the half-axes of the first and second ellipses have the same length; the first and the second ellipse sections become a single section of a circle.

In accordance with an additional feature of the invention, the first second-order parabola has an apex, and the first circle section merges into the first parabola section with continuous curvature at the apex. In this way, a discontinuity of the curvature and peeling off of the flow is reliably prevented at the transition between the first circle section and the first parabola section.

In accordance with again another feature of the invention, the second-order parabola has an apex, and the third circle section merges into the second parabola section with continuous curvature at the apex. Therefore, a discontinuity of the curvature and peeling of the flow is reliably prevented at the transition between the third circle section and the second parabola section as well.

In accordance with again a further feature of the invention, the blade has a base and a tip, and the profile contour is formed of second order curves having parameters which vary between the base and the tip. Thus, a fast and uncomplicated construction of cylindrical, and in particular twisted, turbo-machine blades- is possible, having dimensions along the blade which may be constant or variable. The changes of the dimensions may be linear, exponential, made according to a body of constantly tensile strength, or according to any desired given law of variation.

In accordance with a concomitant feature of the invention, there is provided , in a turbo-machine blade having a profile contour with leading edge, suction side, trailing edge and pressure side regions, the improvement comprising a parabola section of a second-order parabola forming part of the pressure side region.

Other features which are considered as characteristic for the invention are set forth in the appended claims.

Although the invention is illustrated and described herein as embodied in a turbo-machine blade, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
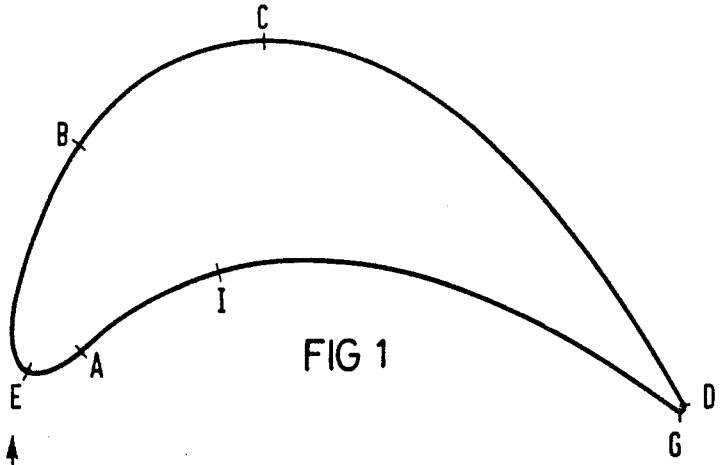
FIG. 1 is a diagrammatic elevational view of a profile contour of a turbo-machine blade which is formed by two sections of an ellipse, too sections of a parabola and three sections of a circle.

Referring now to the figures of the drawing and first particularly to FIG. 1 thereof, there is seen a profile contour of a turbo-machine blade with a total of seven profile sections which merge into each other with continuous slope. Starting in the transition region between the pressure side and the leading edge, the profile contour between points A and E is formed by a first ellipse section. This first ellipse section AE is followed by a second ellipse section EB which changes into the suction side region. The further course of the profile contour in the region of the suction section is formed by a first circle section BC and a first parabola section CD of a first second-order parabola following thereon. The trailing edge is formed by a second circle section DG which follows the first parabola section CD. The second circle section DG is followed in the pressure side region by a second parabola section GI of a second-order parabola. The further course of the pressure side is then determined by a third circle section IA, which follows the second parabola section GI and merges toward the leading edge into a first ellipse section EA.

Figure 2:
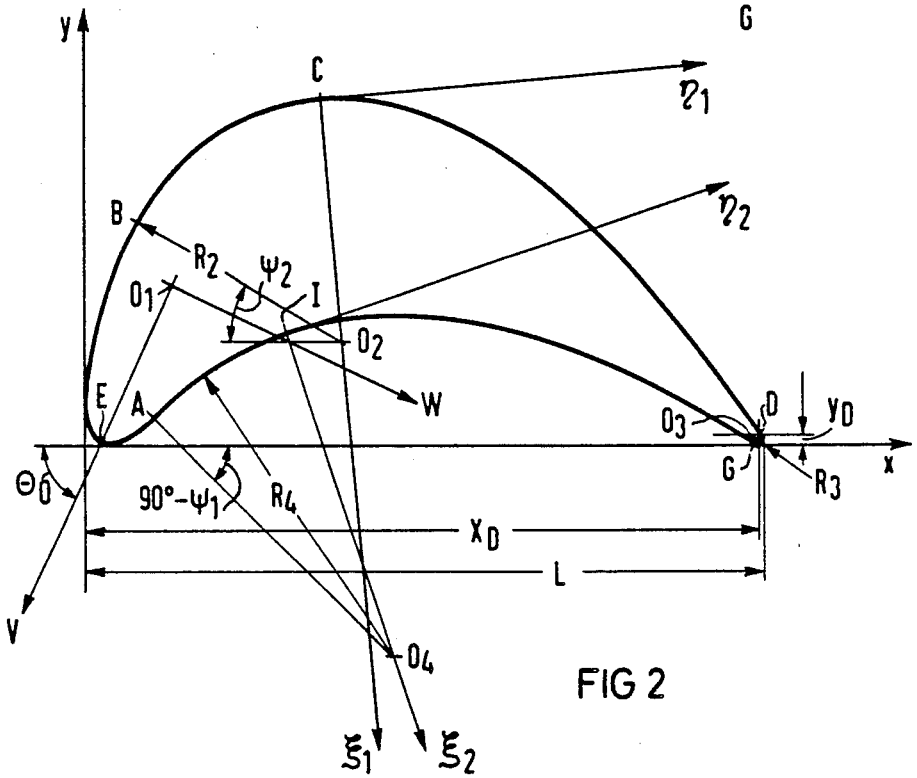
FIG. 2 is a diagrammatic and graphical illustration of the profile contour shown in FIG. 1, with the reference axes and parameters of the individual curve sections.

For a further explanation of the profile contour shown in FIG. 1, reference is made to FIG. 2. FIG. 2 illustrates a plane Cartesion coordinate system x-y with the abscissa axis x and the ordinate axis Y serving as the reference system. The abscissa axis x is tangent to the profile contour in the region of the trailing edge and at the leading edge, and the ordinate axis y is tangent to the profile contour in the region of the leading edge.

The first ellipse section AE is locally referred to a coordinate system V-W, the center of which is designated with reference symbol $O_1$ and the abscissa axis V of which forms an angle $\theta_o$ with the abscissa axis x of the main system. The first ellipse section AE can then be described by the center equation:

$$W = \frac{1}{k_2} \sqrt{V_o^2 - V^2}$$

where $V_o$ designates the major half-axis, $W_{o2}$ the minor half-axis and $k_2 = C_o/W_{o2}$, the ratio of the The second ellipse section EB is likewise locally referred to the coordinate system V-W and can be described by the center equation:

$$W = \frac{1}{k_1} \sqrt{V_o^2 - V^2}$$

where $V_o$ designates the major half-axis, $W_{o1}$ the minor half-axis and $k_1 = V_o/W_{o1}$, the ratio of Since the major half-axis $V_o$ is the same for both ellipses, the point E forms a common apex of the first ellipse section AE and the second ellipse section EB.

The first circle section BC is determined by a circle, the center of which is designated with reference symbol $O_2$ and the radius of which is designated with reference symbol $R_2$.

The first parabola section CD of the first second-order parabola is locally referred to a coordinate system $\xi_1 - \eta_1$, the origin of which is at the point C and the abscissa axis $\xi_1$ of which passes through the center $O_2$ of the first circle section BC. The first parabola section CD can then be described by the apex equation:

$$\eta_1^2 = 2R_2\xi_1$$

From this apex equation it may also be seen that the radius of the first circle section BC is equal to the radius of the apex circle of the first second-order parabola. The first circle section BC can therefore also be described by the apex equation:

$$\eta_1^2 = \xi_1(2\,R_2 - \xi_1)$$

The second circle section DG is determined by a circle having a center which is designated with reference symbol $O_3$ and having a radius which is designated with reference symbol $R_3$. This circle is referred to the coordinate system x-y and is tangent to the abscissa axis x.

The second parabola section GI of the second second-order parabola is locally referred to a coordinate system $\xi_2-\eta_2$, the origin of which is at the point I and the abscissa axis $\xi_2$ of which passes through the center $O_4$ of the third circle section IA. The second parabola section GI can then be described by the apex equation:

$$\eta_2^2=2\,R_4\xi_2$$

where the radius of the apex circle of the second second-order parabola is designated with reference symbol $R_4$. Since this radius $R_4$ also corresponds to the radius of the third circle section IA, the center of which is at the point $O_44$, the third circle section IA can therefore also be described by the apex equation:

$$\eta_2^2=\xi_2(2\,R_4-\xi_2)$$

However, the third circle section IA with the center $O_4$ can also be referred to the coordinate system x - y.

In FIG. 2, the length of the profile contour is furthermore designated with reference symbol L. Reference symbol $\psi_1$ designates the angle between the normal at the point A and the ordinate axis y, and reference symbol $\psi_2$ designates the angle between the normal at the point B and the abscissa axis x.

The shape of the profile contour is then determined by the following eleven parameters:

1. The profile length L,
2. the magnitude of the half-axis ratio $k_1$,
3. the magnitude of the half-axis ratio $k_2$,
4. the length of the half-axis $V_O$,
5. the magnitude of the angle $\theta_O$,
6. the length of the apex circle radius $R_2$ of the first second-order parabola,
7. the length of the apex circle radius $R_4$ of the second second-order parabola,
8. the magnitude of the angle $\psi_1$,
9. the magnitude of the angle $\psi_2$,
10. the length of the coordinate $x_D$ of the point D and
11. the length of the coordinate $y_D$ of the point D.

By varying the above-mentioned parameters, a suitable profile contour can be founding the construction of a turbo-machine blade which meets the aerodynamic and mechanical requirements.

Figure 3:
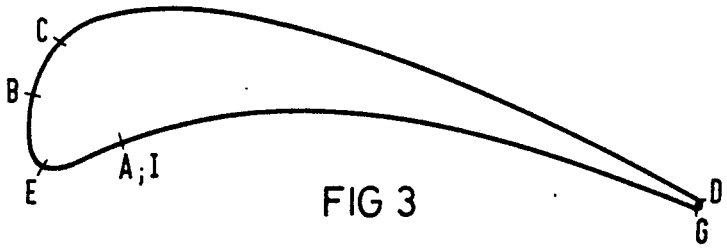
FIG. 3 is a view similar to FIG. 1, of a profile contour which is formed by two ellipse sections, two parabola sections and two circle sections.

FIG. 3 shows a further profile contour in which the reference systems and the individual parameters have not been illustrated, in order to simplify the drawing. However, the reference systems and parameters shown in FIG. 2 are to apply in the same manner for the profile contour shown in FIG. 3 as well.

In the profile contour shown in FIG. 3, the first circle section BC has a relatively small radius $R_2$. The smaller that this radius $R_2$ of the first circle section BC or the apex circle of the first second-order parabola is chosen, the flatter the first parabola section CD becomes. In the profile contour shown in FIG. 3, the arc length of the third circle section IA is furthermore so small that the points I and A practically coincide.

In general, the following influences a through h of the parameters on the profile shape are to be observed in the construction of a profile contour:

(a) The influence of the half-axis ratios $k_1$ and $k_2$

Case 1: $k_1=k_2>1$

The ellipse sections AE and EB are symmetrical to the abscissa axis V.

In general it can be stated that as the ratios $k_1$ and $k_2$ become larger, the ellipse sections AE and EB move that much closer to the abscissa axis $V_O$.

Case 2: $1<k_1\neq k_2>1$ ellipse section with the smaller k-value is further removed from the abscissa axis V than the ellipse section with the larger k-value.

Case 3: $k_1=k_2=1$.

In this case, the ellipse is changed into a circle with the radius $R_1=V_O$.

(b) The influence of the length of the half-axis $V_O$.

The magnitude of the half-axis $V_O$ together with the half-axis ratios $k_1$ and $k_2$ directly influences the shape of the ellipse sections AE and EB.

(c) The influence of the angle $\theta_O$.

The larger the angle $\theta_O$, the more curved the profile contour becomes, and vice versa.

(d) The influence of the radius $R_2$

The first parabola section CD becomes flatter, as the radius $R_2$ becomes smaller.

(e) The influence of the radius $R_4$.

The second parabola section GI becomes flatter, as the radius $R_4$ becomes smaller.

(f) The influence of the angle $\psi_1$.

With increasing angle $\psi_1$, the first ellipse section AE becomes longer and the radius $R_4$ becomes shorter.

(g) The influence of the angle $\psi_2$.

With increasing angle $\psi_2$, the second ellipse section EB becomes longer.

(h) The influence of the coordinates of the point D.

The increase of the ordinate value $y_D$ causes an increase of the second circle section DG.

The value of the abscissa $x_D$ influences the location of the curvature maximum in the region of the suction side.

With the aid of the parameters given, one is in a position to construct profiles with the required strength properties and aerodynamic shapes. After the aerodynamic calculations are made and on the basis of the results obtained, an aerodynamic optimization can be performed by minor changes of suitable parameters without impairment of the required strength properties. For the development of the profile contour, the strength calculation, the aerodynamic computation and the aerodynamic optimization, suitable programmed computers can be used.

The foregoing is a description corresponding to German application No. P 32 01 436.8, dated Jan. 19, 1982, the International priority of which is being claimed for the instant application, and which is hereby made part of this application. Any discrepancies between the foregoing specification and the aforementioned corresponding German application are to be resolved in favor of the latter.

I claim:

1. Turbo-machine blade, comprising:

a continuously curved profile contour having convex curved leading edge, suction side and trailing edge regions, and a concave curved pressure side region;

said leading edge region being formed of a first ellipse section and a second ellipse section adjacent said first ellipse section;

said suction side region being formed of a first circle section adjacent said second ellipse section and a first parabola section of a first second-order parabola being adjacent said first circle section;

said trailing edge region being formed of a second circle section adjacent said first parabola suction and said pressure side region being formed of a third circle section adjacent said first ellipse section and a second parabola section of a second second-order parabola being disposed between said second circle section and said third circle section.

2. Turbo-machine blade according to claim 1, wherein said first and said second ellipse sections are formed of respective first and second ellipses having a common major half-axis, and said first and second ellipse sections merge into each other at a common apex lying on said major half-axis.

3. Turbo-machine blade according to claim 2, wherein said first and second ellipses have minor half-axes of equal length.

4. Turbo-machine blade according to claim 3, wherein said major and minor half-axes of said first and second ellipses have the same length 5. Turbo-machine blade according to claim 1, wherein said first second-order parabola has an apex, and said first circle section merges into said first parabola section with continuous curvature at said apex.

6. Turbo-machine blade according to claim 1, wherein said second second-order parabola has an apex, and said third circle section merges into said second parabola section with continuous curvature at said apex.

7. Turbo-machine blade according to claim 1, wherein the blade has a base and a tip, and said profile contour is formed of second order curves having parameters which vary between said base and said tip.

* * * * *